United States Patent [19]

Kehlenbach

[11] Patent Number: 4,648,251

[45] Date of Patent: Mar. 10, 1987

[54] MACHINE FOR DYEING, FINISHING AND IMPREGNATING A SPREAD OF FABRIC WEB

[75] Inventor: Günther Kehlenbach, Würselen, Fed. Rep. of Germany

[73] Assignee: H. Krantz, GmbH & Co., Aachen, Fed. Rep. of Germany

[21] Appl. No.: 690,109

[22] Filed: Jan. 9, 1985

[30] Foreign Application Priority Data

Feb. 3, 1984 [DE] Fed. Rep. of Germany ..... 3403784

[51] Int. Cl.[4] ..... D06B 3/12

[52] U.S. Cl. ..... 68/15; 68/22 R; 68/175; 68/208

[58] Field of Search ..... 68/15, 22 R, 175, 208; 118/421; 248/654, 666

[56] References Cited

U.S. PATENT DOCUMENTS

| | | | |
|---|---|---|---|
| 1,315,698 | 9/1919 | Bailey | 68/22 R |
| 1,608,932 | 11/1926 | Fischer | 68/10 |
| 1,950,010 | 3/1934 | Riggs et al. | 68/22 R |
| 2,189,914 | 2/1940 | Mellor et al. | 68/22 R |
| 2,276,605 | 3/1942 | Andrews | 68/22 R |
| 2,500,041 | 3/1950 | Morey | 118/421 |
| 2,561,092 | 7/1951 | Bell | 118/421 X |
| 2,583,267 | 1/1952 | Jones et al. | 118/421 X |
| 2,839,025 | 6/1958 | Burke et al. | 118/421 X |
| 3,058,332 | 10/1962 | Hoffmann | 68/22 R X |
| 3,093,051 | 6/1963 | Ritzerfeld et al. | 118/421 X |
| 3,285,225 | 11/1966 | Recor | 118/421 X |
| 3,848,439 | 11/1974 | Lopata | 68/184 |
| 4,158,297 | 6/1979 | Winch | 68/22 R |
| 4,532,782 | 8/1985 | Sellers | 68/22 R |

FOREIGN PATENT DOCUMENTS

| | | | |
|---|---|---|---|
| 1170920 | 11/1969 | United Kingdom | 68/175 |
| 1193233 | 5/1970 | United Kingdom | 68/175 |
| 138213 | 5/1960 | U.S.S.R. | 68/175 |

*Primary Examiner*—Harvey C. Hornsby
*Assistant Examiner*—Frankie L. Stinson
*Attorney, Agent, or Firm*—Arthur B. Colvin

[57] ABSTRACT

A fabric treatment apparatus for advancing a web of fabric through a bath while spreading deflecting and squeezing same is disclosed. The apparatus includes a moveable trough for the treatment liquid and a displacement body which is completely submerged in the trough in the operative condition of the apparatus, the displacement body also functioning as a heat exchanger.

3 Claims, 1 Drawing Figure

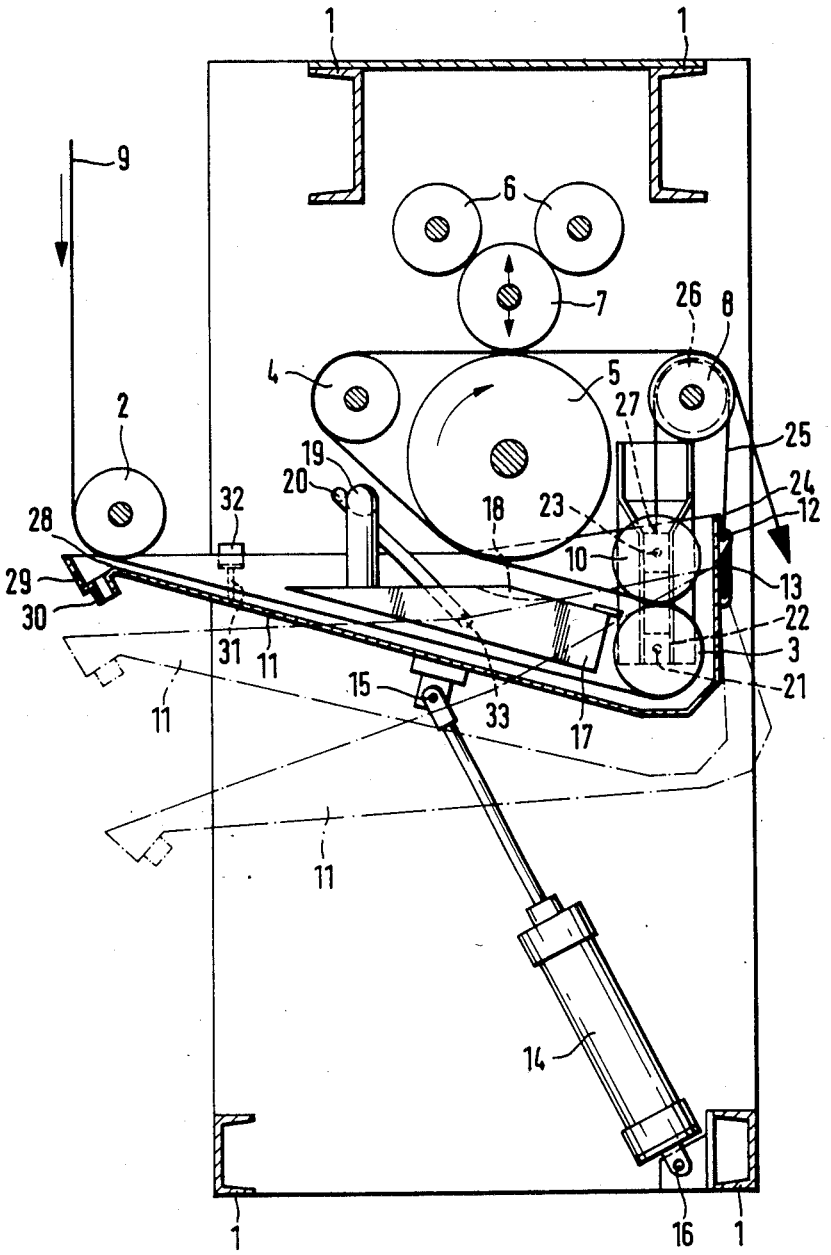
1
1
9
6
7
26
8
4
5
27
2
25
19
20
24
12
32
18
23
28
10
13
29
30
22
3
31
11
21
15
33
17
11
11
14
1
16
1

MACHINE FOR DYEING, FINISHING AND IMPREGNATING A SPREAD OF FABRIC WEB

Machines for dyeing, finishing and impregnating a spread fabric web (Foulard Machines) conventionally include a frame. A trough for a bath is arranged on the frame through which trough a section of the fabric web passed over rolls mounted in the frame can be transported continuously and can be squeezed between a pair of rolls, namely a pressure roll and a counter-roll, mounted above the trough.

The known machines of this kind have two essential disadvantages, which consist in that at the beginning of a treatment process it is difficult to guide the web around the rolls mounted inside the trough, and after the treatment process cleaning of the interior of the trough and of the rolls mounted therein is very complicated. Despite at least one guide roll being disposed inside the trough, which reduces the volume of bath contained in the trough, the known machines require relatively high quantities of bath in proportion to the length of the web section present in the trough, resulting in an unfavorable bath ratio as an additional disadvantage.

It is an object of the invention to improve a machine of the initially mentioned kind in such a way that the fabric web can be introduced unhindered and that the trough and the rolls coming in contact with the bath can be cleaned easily, at a low bath ratio, i.e. the required quantity of bath relative to the length of the web section passed through the bath.

To solve the noted problems, the present invention proposes the provision of an apparatus wherein the trough may be readily made accessible for easy fabric feed and may be readily emptied. Additionally, there is provided a displacement body which occupies a substantial volume of the trough and which serves as a heat exchange medium.

With the trough being mounted on the frame in a manner variable in position, the trough can, for example, be turned down inside the frame in such a way that the beginning of the fabric web can be passed unhindered around a guide roll received by the trough in the inoperative position thereof. Thereafter the trough can, for example, be brought into the operating position by an upwardly directed turning movement, or a turning and lifting movement, so the trough receives the displacement body designed as heat exchanger, which is fixed in the frame. After completion of the treatment process, the trough can, for example, be turned down again, so that the guide roll and the displacement body as well as the interior of the trough are accessible for thorough cleaning. With the displacement body serving as heat exchanger, no additional heat exchangers need be provided. Moreover, the design of the displacement body as heat exchanger ensures optimum heat exchange, as the displacement body is entirely surrounded by bath.

According to a development of the invention, the displacement body protrudes into the trough in the operating position thereof so deeply that the bath not only completely surrounds the surface of the displacement body, but a lower inner side of the trough limits together with a lower outer side of the displacement body the free cross-section of a run-through length of the fabric web on the top or bottom side thereof.

This makes it possible to dimension the displacement body so that relatively little bath is sufficient to obtain a relatively long treatment path. By bringing the lower inner side of the trough close to the lower outer side of the displacement body, the cross-section of the treatment path can be reduced so that contact between the fabric web and the trough bottom is just barely prevented.

According to an especially advantageous development of the invention, the side walls of the trough are essentially triangular, the trough pivoting about an axle mounted in the region of a corner point of the side walls, the two bearings of said axle, guided in a vertically oriented slide, being adjustable in height.

While due to the triangular side walls of the trough the trough volume can be reduced without detriment to the run-through distance for the fabric web, by the arrangement of the axles in the corner points of the side walls the trough can be turned for complete evacuation in a simple manner. Since, according to the invention, the bearings are adjustable in height, the trough can be lowered as a whole in addition to the turning movement, thereby additionally facilitating access to the interior of the trough and to the other machine parts enclosed by the trough in its operating position.

According to another development of the invention, at each heightwise adjustable bearing, one end of a traction element is fastened. The traction elements are passed over a guide roll and reversed by about 180 degrees, being attached at the other end to a heightwise adjustable bearing of a roll which rests on a roll lying inside the trough in the operating position, said bearing being guided in a vertically oriented slide.

With this design, when the trough is lowered, the roll which rests on the roll lying inside the trough is automatically lifted off the latter, so that both rolls are then always completely accessible as long as the trough is not in the operating position. In the lifted position of the roll the beginning of the fabric web can readily be passed between the two rolls.

On a side of the trough opposite the axle, there is provided, according to another development of the invention, a bath overflow edge, which is formed by the bottom of the trough ascending toward that side, and which is followed by a gutter opening into a drain pipe.

Due to this design, it is possible with an appropriate turning movement of the trough to completely empty the trough via the gutter and the drain pipe connected thereto, without the need for any other evacuating pipe with valve means.

The displacement body serving as heat exchanger is preferably hollow, the cavity being connected to an input and to a return flow line of a heating medium.

In the cavity of the displacement body a steam lance in the form of a perforated tube can be provided, which permits a very uniform temperature distribution over the full width of the trough if, for example, the steam connection is on one side. For this purpose a hot water/steam heating system is advisable, whereby the steam pressure can easily be limited to 1 bar.

In addition, a development of the invention provides that at each of the side walls of the trough, near the overflow edge, a lateral projection is provided, which in the operating position of the trough abuts against a stop element fixed on the frame and presents at the same time an oblique position crosswise to the plane in which the fabric runs.

With the lateral projections on the trough and the respective stop elements, it is possible to limit the highest position of the trough relative to the guide rolls mounted fixed in the frame without the passing fabric web dragging over the bottom of the trough. With the lateral projections on the trough and the stop elements fixed on the frame it can also be ensured that the fabric web is transported through the bath over the optimum length of a run-through distance for the latter without having bath run off over the overflow edge prematurely.

Lastly, a development of the invention provides a cylinder-piston rod unit pivotally connected at its ends to the trough and frame respectively.

With an appropriate control of the cylinder-piston rod unit, the trough can be turned up and down inside the frame, for example, through a manually operated valve controlling flow to the cylinder, and flooding of the gutter at the overflow edge is prevented by throttling the valve when the trough is being turned down.

The machine according to the invention permits a relatively shallow trough to be used, so that below the trough enough space remains in the machine frame, at least when the trough is in operating position, to integrate a batch and reserve bath tank. If these tanks are also portable, the space inside the frame is available for them when the trough requires a down-turned and lowered position outside is operating position.

In the drawing, an embodiment of the machine according to the invention is illustrated schematically in partially vertical transverse section.

At or in a frame formed by sectional members 1, there are rotatably mounted a spreading or guide roll 2, a trough roll 3, a spreading or full-width roll 4, as well as a counter-roll 5, a pressure roll 7 bearing the load of support rollers 6 and guide roll 8. The pressure roll 7 is operatively connected to a piston and cylinder assembly so as to be removable pneumatically in inoperative position. The fabric web 9 is passed in arrow direction over or between the rolls in the stated order. In addition, a supported roll 10, adjustable in height, is provided in the frame. The roll 10 is arranged above the trough roll 3 and bears against the roll 3 in the operative condition of the device. The supported roll 10 is necessary if through it and the trough roll 3 an additional squeezing mechanism besides the one formed by the rolls 5 and 7 is needed.

Inside the frame a trough 11 is arranged, which pivots about an axle 12. As the axle 12 is displaceable in a vertically oriented slide 13, trough 11 can be moved into the position shown in dash-dot lines by a turning as well as by a lowering movement. For this a cylinder-piston rod unit 14 is used which engages outside the center of gravity of the trough and is connected by one end with the trough 11 via a pivot joint 15 and by the other end with a sectional member 1 of the frame via a pivot joint 16. The cylinder-piston rod unit 14 can be pressurized through a supply line (not shown) having a corresponding valve control.

In the frame a displacement body 17 is arranged rigidly in such a way that in the operating position of the trough the body 17 is received completely within the trough as is the trough roll 3 which is likewise mounted on the frame. The hollow displacement body 17 serves as a heat exchanger and has on it side toward the counter-roll a concavity 18 over a width of about 150-mm, so that the center of the fabric web 9 can be gripped here and the web can be passed unhindered between the fixed displacement body 17 and the counter-roll 5.

By means of a hot water return line 19 disposed on the upper side of the displacement body as well as by means of a steam admission line 20 connected to the side of the displacement body 17, the displacement body can be retained in the frame in such a way that the trough 11 can be freely moved into its operative position embracing the displacement body 17 without interference.

For uniform heating over the width of trough 11, the steam admission line 20 opens into a perforated tube 33 disposed inside trough 11 and extending over the width thereof, said tube acting as a so-called steam lance.

So that the mounting of the pressure roll 3 will not impede the up and down movement of the trough 11, bearings 21 of roll 3 are fastened in a vertically oriented slide 22, which serves also to guide height-adjustable bearings 23 of the supported roll 10. At the axles 12 of trough 11, ends 24 of flexible traction elements 25 are fastened. The traction elements are passed over guide rollers 26 to the bearings 23. Hence, if trough 11 is lowered by slide 13, the supported roll 10 is necessarily raised via its bearings 23 and is thus spaced a distance from the trough roll 3.

But before a lowering of the bath-filled trough 11 from the shown operating position occurs, the trough can be pivoted about the axle 12 by a shortening of the cylinder piston rod unit 14, so that the bath content continuously passes an overflow edge 28 on the side of trough 11 opposite axle 12, whereupon the bath flows via a gutter 29 toward a pipe 30, to which a hose or flexible tube is connected to drain the bath off. In this way trough 11 may be completely emptied by a corresponding pivotal movement.

If the trough 11 is to be brought into the operating position again, lateral projections 31 at trough 11 near the overflow edge 28 limit the upward movement of the trough, in that each of the projections 31 strikes against a stop element 32 fixed on the frame.

From the foregoing it will be appreciated that there is provided, in accordance with the present invention, a fabric treatment apparatus which may be conveniently and efficiently loaded, cleaned and emptied. The apparatus makes efficient use of the treatment bath due to the presence of the displacement body which also functions as a heat exchanger and guide for the fabric.

As will be evident to those skilled in the art and familiarized with the instant disclosure, numerous variations in details of construction may be made without departing from the spirit of the invention. Accordingly, the same is to be broadly construed within the scope of the appended claims.

Having thus described the invention and illustrated its use, what is claimed as new and is desired to be secured by Letters Patent in the United States is:

1. In a dyeing, finishing and impregnating apparatus for the processing of a spread fabric web of the type comprising a frame, a trough for a bath through which a section of fabric may be continuously advanced, said device including a pressure roll and a counter roll mounted on said frame above said trough, the improvement which comprises said trough having generally triangular sidewalls, variable mounting means interposed between said frame and trough and supporting said trough, said mounting means including a slide member vertically movably mounted on said frame, a support axis on said trough in the region of a corner portion of said sidewall, said axis being secured to said slide member, and means for shifting said slide member in a vertical direction between operative and inoperative positions, a displacement body including a heat exchanger mounted to said frame, said displacement body being completely immersed in said trough in the operative position thereof and being at least partially clear of said trough in said inoperative position, the lower inner surfaces of said trough and the lower outer surfaces of said body together defining a guideway for a length of fabric traversing said trough, a trough roll mounted in said trough, a support roll disposed above said trough, said rolls having their axes in parallel alignment with said support roll being supported by said trough roll in said operative position, vertical guide means fixed to said frame, said trough and support rolls including bearings mounted in said vertical guide means, a guide roll mounted on said frame above said support roll, and a traction element having a first end connected to said support axis of said trough and a second end connected to said support roll, said traction member being passed over said guide roll, whereby downward movement of said trough effects upward movement of said support roll.

2. In a dyeing, finishing and impregnating apparatus for the processing of a spread fabric web of the type comprising a frame, a trough for a bath through which a section of fabric may be continuously advanced, said device including a pressure roll and a counter roll mounted on said frame above said trough, the improvement which comprises variable mounting means interposed between said frame and trough, said mounting means comprising bearing means on said trough supported on said frame for enabling pivotal movement of said trough relative to said frame and means for vertically shifting said bearing means relative to said frame whereby said trough is supported for movement between operative, inoperative and intermediate positions relative to said frame, and a displacement body including a heat exchanger mounted to said frame, said displacement body being completely immersed in said trough in the operative position thereof and being at least partially clear of said trough in said inoperative position, said apparatus being further characterized in that the lower inner surfaces of said trough and the lower outer surfaces of said body together define a guideway for a length of fabric traversing said trough, said side walls of said trough being generally triangular, said bearing means being connected to said trough in the region of a corner point of said side wall, the bottom of said trough being inclined in said operative position with the low point of said bottom wall being generally vertically aligned with said bearing means, and a cylinder and piston unit interposed between said frame and the undersurface of said trough, the distal ends of said unit being pivotally connected to said frame and trough respectively, the point of connection of said unit to said trough being such that the center of gravity of said trough is interposed between said mounting means and said point of connection.

3. In a dyeing, finishing and impregnating apparatus for the processing of a spread fabric web of the type comprising a frame, a trough for a bath through which a section of fabric may be continuously advanced, said device including a pressure roll and a counter roll mounted on said frame above said trough, the improvement which comprises variable mounting means interposed between said frame and trough, said mounting means comprising bearing means on said trough supported on said frame for enabling pivotal movement of said trough relative to said frame and means for vertically shifting said bearing means relative to said frame whereby said trough is supported for movement between operative, inoperative and intermediate positions relative to said frame, and a displacement body including a heat exchanger mounted to said frame, said displacement body being completely immersed in said trough in the operative position thereof and being at least partially clear of said trough in said inoperative position, said apparatus being further characterized in that the lower inner surfaces of said trough and the lower outer surfaces of said body together define a guideway for a length of fabric traversing said trough, said side walls of said trough being generally triangular, said bearing means being connected to said trough in the region of a corner point of said side wall, the bottom of said trough being inclined in said operative position with the lower point of said bottom wall being generally vertically aligned with said bearing means, and a trough roll mounted in said trough a support roll disposed above said trough roll, said rolls having their axes in parallel alignment, with said support roll being supported by said trough roll in said operative position, guide means interposed between said frame and said support roll for enabling vertical movement of said support roll, a guide roll mounted on said frame above said support roll and a traction element arrayed over said guide roll and having a first end operatively connected to said trough and a second end operatively connected to said support roll whereby downward movement of said bearing means effects upward movement of said support roll.

* * * * *